US011239605B2

(12) United States Patent
Chen

(10) Patent No.: US 11,239,605 B2
(45) Date of Patent: Feb. 1, 2022

(54) TRANSITION BLOCK FIXING ASSEMBLY

(71) Applicant: CommScope Technologies LLC, Hickory, NC (US)

(72) Inventor: Chen Chen, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 281 days.

(21) Appl. No.: 16/583,454

(22) Filed: Sep. 26, 2019

(65) Prior Publication Data

US 2020/0136312 A1 Apr. 30, 2020

(30) Foreign Application Priority Data

Oct. 24, 2018 (CN) ..... 201811239564.5

(51) Int. Cl.

| | |
|---|---|
| ***H01Q 1/24*** | (2006.01) |
| ***H01R 13/639*** | (2006.01) |
| ***H01Q 1/50*** | (2006.01) |
| ***H01R 4/02*** | (2006.01) |
| *H01R 24/52* | (2011.01) |

(52) U.S. Cl.

CPC ..... *H01R 13/639* (2013.01); *H01Q 1/246* (2013.01); *H01Q 1/50* (2013.01); *H01R 4/021* (2013.01); *H01R 4/027* (2013.01); *H01R 24/52* (2013.01); *H01R 2201/02* (2013.01)

(58) Field of Classification Search

CPC ..... H01Q 1/12; H01Q 1/246; H01R 24/52; H01R 2201/02; H01R 4/021

See application file for complete search history.

(56) References Cited

U.S. PATENT DOCUMENTS

| | | | | |
|---|---|---|---|---|
| 2016/0308286 | A1* | 10/2016 | Schmutzler | H01R 24/52 |
| 2017/0214133 | A1* | 7/2017 | Orem | H01Q 1/427 |
| 2019/0058261 | A1* | 2/2019 | Yman | H01Q 21/26 |
| 2019/0305400 | A1* | 10/2019 | Su | H01R 13/6315 |

* cited by examiner

*Primary Examiner* — Hasan Islam

(74) *Attorney, Agent, or Firm* — Myers Bigel, P.A.

(57) ABSTRACT

A transition block fixing assembly has a transition block mounting unit that includes a support member and a connecting member. The support member is configured to support a transition block and a pair of cables that are received within the transition block, and the connecting member is configured to mount the transition block mounting unit within a base station antenna.

17 Claims, 9 Drawing Sheets

TRANSITION BLOCK FIXING ASSEMBLY

CROSS-REFERENCE TO RELATED APPLICATION

The present application claims priority to Chinese Patent Application Serial No. 201811239564.5, filed Oct. 24, 2018, the entire content of which is incorporated herein by reference.

FIELD

The present invention generally relates to the field of base station antennas. More specifically, the present invention relates to a transition block fixing assembly that may be used to mount a transition block and cables that are connected to the transition block within a base station antenna.

BACKGROUND

Transition blocks are used in base station antennas to weld together pairs of cables that are connected to different electrical elements (e.g., diplexers, feed boards, phase shifters, radiating units, etc.) of the base station antenna. Conventionally, after the cables and the transition block are welded, a heat shrinkable tube is used to enclose the junctions of the cables and the transition block, and then a tie is used to mount the heat shrinkable tube within the base station antenna. This mounting method has several disadvantages. For example, since the welded portion is enclosed by the heat shrinkable tube, it is difficult to gain access to the welded connection in the event that defects are present and the weld needs to be replaced. In addition, the above-described conventional fixing operation may only be performed manually, and it is not possible to use machines to automate the process.

SUMMARY

One aspect of the present invention relates to a transition block fixing assembly. The transition block fixing assembly comprises a transition block mounting unit. The transition block mounting unit includes an upper support member and a lower connecting member. The upper support member is configured to support a transition block and a pair of cables that are received within the transition block, and the lower connecting member is configured to mount the transition block mounting unit within the base station antenna.

In some embodiments, the support member includes a transition block support portion, and cable support portions located on opposed longitudinal sides of the transition block support portion.

In some embodiments, the transition block support portion includes a transition block bottom plate, and a plurality of transition block claws projecting upwardly from transverse sides of the transition block bottom plate.

In some embodiments, the transition block claw includes a stem, and a hook projecting from a top of the stem toward the interior of the support member.

In some embodiments, the transition block claw further includes a hook projecting from a side of the stem toward the interior of the support member.

In some embodiments, the stem is plate-shaped and protrudes upward in a cantilevered manner.

In some embodiments, the cable support portion includes a cable bottom plate, and a plurality of cable claws projecting upwardly from opposed transverse sides of the cable bottom plate.

In some embodiments, the cable bottom plate is connected to the longitudinal sides of the transition block bottom plate.

In some embodiments, the cable claws are undulating cable claws.

In some embodiments, the cable support portions have different numbers of cable claws.

In some embodiments, a chamfer is provided between the intersections of the sides of the cable claws.

In some embodiments, transversely-extending ribs are provided below the cable bottom plate.

In some embodiments, the connecting member is fixed below the support member, and includes an upper connecting portion and a lower connecting portion that are connected to each other.

In some embodiments, the upper connecting portion is substantially plate-shaped, and includes a body and an elastic pressing portion projecting from both longitudinal sides of the body.

In some embodiments, the lower connecting portion has a substantially cross shape, which has a center connected to the upper connecting portion by a cylindrical body.

In some embodiments, the transition block mounting unit is integrally molded.

In some embodiments, the transition block fixing assembly further includes a beam on which the one or more transition block fixing means are mounted.

In some embodiments, the beam is substantially elongated and plate shaped.

In some embodiments, the beam includes an elongated base plate, and support plates projecting vertically upward from both transverse sides of the base plate.

In some embodiments, the base plate is provided with a cross-shaped hole, and a lower connecting portion of the connecting member including an upper connecting portion and the lower connecting portion is correspondingly substantially cross-shaped.

In some embodiments, the base plate is provided with holes, and an upper connecting portion of the connecting member including the upper connecting portion and a lower connecting portion are provided with flanges so that rotation of the connecting member through a predetermined angle allows the flanges to clamp into respective holes in the base plate.

In some embodiments, the support plate is provided with cut-outs so projections of the lower surface of the cable support portion are received in the cut-outs when the connecting member is rotated through the predetermined angle.

In some embodiments, the beam is fixed to the base station antenna by an adapter which includes a base plate connecting portion and a base station antenna connecting portion that are connected to each other.

In some embodiments, the base plate connecting portion is provided with a screw hole for fixing to the base plate by a screw, and the base station antenna connecting portion is provided with a projection, for clamping into a slot in a side wall of the base station antenna.

Another aspect of the present invention relates to a transition block fixing assembly. The transition block fixing assembly comprises a transition block mounting unit. The transition block mounting unit is configured to receive a transition block and a first and second cables that are electrically connected to each other within the transition block. The transition block mounting unit is configured to be mounted in an opening within a structural component of a base station antenna by inserting the transition block mounting unit within the opening and moving the transition block mounting unit within the opening.

In some embodiments, moving the transition block mounting unit within the opening comprises sliding the transition block mounting unit within the opening.

In some embodiments, moving the transition block mounting unit within the opening comprises rotating the transition block mounting unit within the opening.

In some embodiments, the structural component of the base station antenna may be a beam that includes a plurality of openings.

In some embodiments, the structural component of the base station antenna may be a reflector plate.

In some embodiments, the structural component includes cut-outs that are configured to receive projections included on the transition block mounting unit to mount the transition block mounting unit in place after the transition block mounting unit has been inserted within the opening and rotated.

In some embodiments, the transition block includes first and second openings on opposed sidewalls thereof that are configured to receive respective first and second cables and an opening on a top surface thereof.

In some embodiments, the transition block mounting unit comprises one or more bottom plates and a plurality of cantilevered stems that include claws that are configured to hold the transition block and the first and second cables in place.

DETAILED DESCRIPTION

Figure 1A:
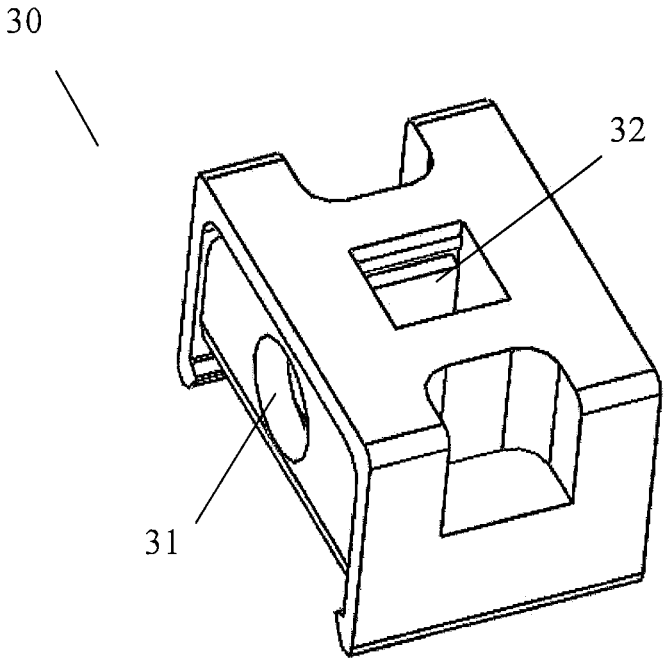
FIGS. 1A and 1B are, respectively, a perspective view of a transition block and a perspective view of the transition block with cables connected thereto.

The present invention will be described below with reference to the drawings, in which several embodiments of the present invention are shown. It should be understood, however, that the present invention may be implemented in many different ways, and is not limited to the embodiments described below. In fact, the embodiments described hereinafter are intended to make a more complete disclosure of the present invention and to adequately explain the scope of the present invention to a person skilled in the art. It should also be understood that, the embodiments disclosed herein can be combined in various ways to provide many additional embodiments.

In the drawings, like reference numerals refer to like elements. In the drawings, for the sake of clarity, the sizes of certain features may be exaggerated.

It should be understood that, the wording in the specification is only used for describing particular embodiments and is not intended to limit the present invention. All terms used in the specification (including technical and scientific terms) have meanings as normally understood by a person skilled in the art, unless otherwise defined. For the sake of conciseness and/or clarity, well-known functions or constructions may not be described in detail.

As used in the specification, the singular forms "a/an" and "the", unless clearly indicated, contain the plural forms. The terms "comprising", "containing" and "including" indicate the presence of the claimed features, but do not preclude the presence of one or more additional features. The term "and/or" includes any and all combinations of the one or more listed items.

When an element is referred to as being "on" another element, "attached to" another element, "connected to" another element, "coupled to" another element, or "in contact with" another element, the element may be directly on, attached to, connected to, coupled to, or in contact with the other element, or there may be intermediate elements present. In contrast, where an element is referred to as being "directly" on another element, "directly attached to" another element, "directly connected to" another element, "directly coupled to" another element, or "in direct contact with" another element, there are no intermediate elements present. In the specification, where one feature is "adjacent" another feature, it may mean that one feature has a portion that overlaps with an adjacent feature or a portion that is located above or below an adjacent feature.

In the specification, terms describing spatial relationships such as "up", "down", "left", "right", "front", "back", "high", "low" and the like may describe a relationship of one feature with another feature in the drawings. It should be understood that these terms also encompass different orientations of the apparatus in use or operation, in addition to the orientations shown in the drawings. For example, when the apparatus in the drawings is turned over, the features previously described as "below" other features may be described to be "above" other features at this time. The apparatus may also be otherwise oriented (rotated 90 degrees or at other orientations) and the relative spatial relationships will be altered accordingly.

In the specification, "longitudinal" refers to the horizontal direction in which the transition block fixing means or beam has a long length, and "transverse" refers to the horizontal direction in which the transition block fixing means or beam has a short length.

Figure 1B:
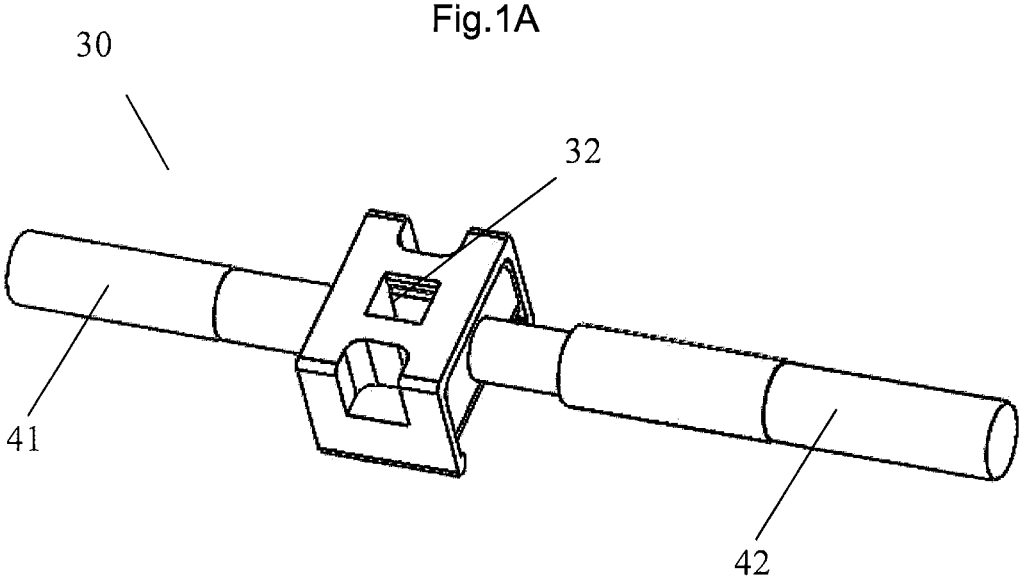

As shown in FIGS. 1A and 1B, the transition block 30 may be generally cuboid or cube shaped, and is used to mechanically and electrically connect two cables 41 and 42 together. The transition block 30 includes opposed through holes 31 that pass through two opposite side walls, and a top hole 32 that opens from the top wall to the through holes 31. The cables 41 and 42 are inserted into the respective through holes 31 from both sides of the transition block 30 and the ends of the respective cables 41, 42 contact each other within the transition block 30. Solder is injected through the top hole 32, and welds and fixes the ends of the cables 41 and 42 together and to the transition block 30. In some embodiments, the cables 41 and 42 may have the same diameters. In other embodiments, the cables 41 and 42 may have different diameters. The cables 41 and 42 may be connected to, for example, diplexers, phase shifters, feed boards, radiating elements and the like.

Figure 2:
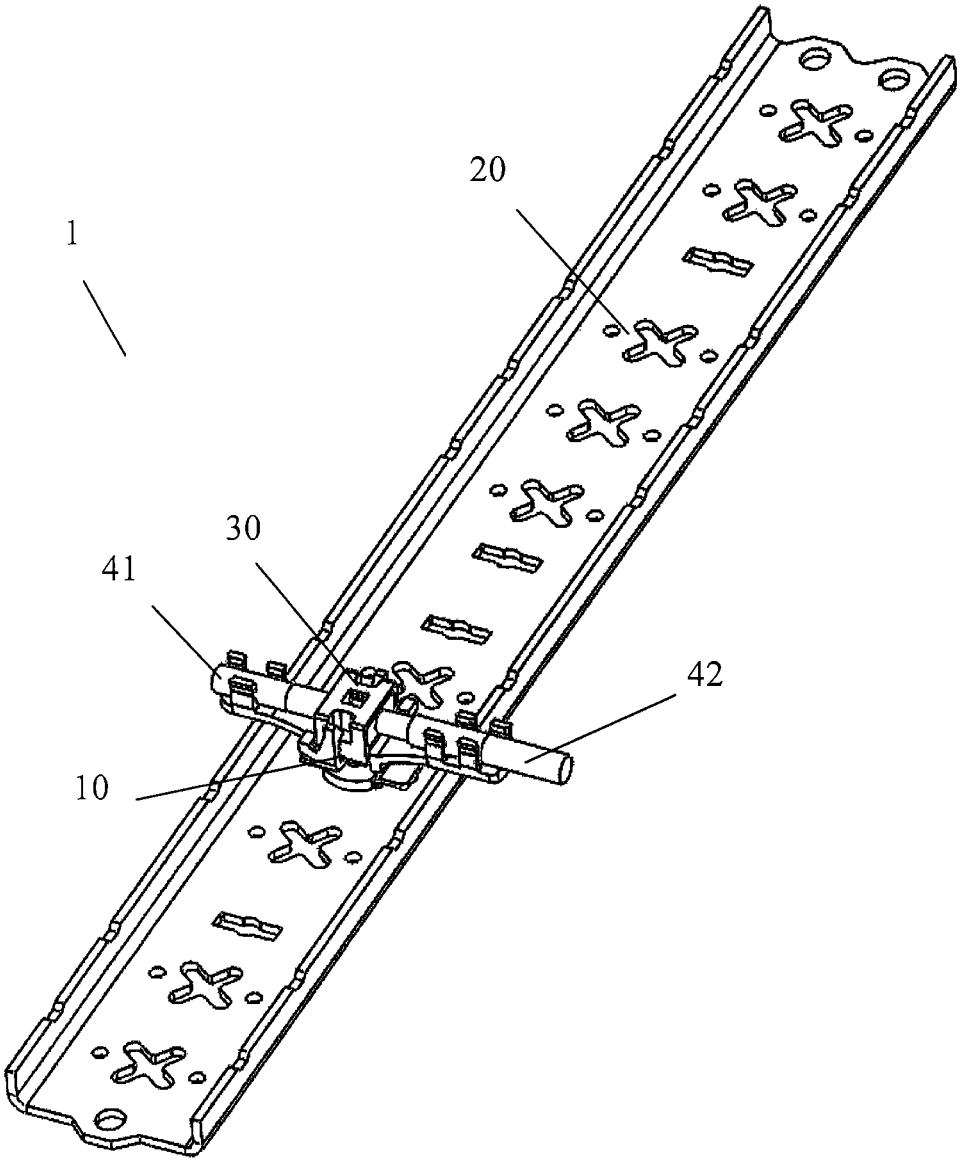
FIG. 2 is a perspective view of a transition block fixing assembly according to an embodiment of the present invention.

FIG. 2 is a perspective view of a transition block fixing assembly 1 according to an embodiment of the present invention. As shown in the drawing, the transition block fixing assembly 1 comprises one or more transition block mounting units 10 (only one of which is shown in FIG. 2 as an example). The transition block mounting unit 10 is used to mount the transition block 30 and the two cables 41 and 42 that are connected by the transition block 30 within the base station antenna. In some embodiments, the transition block fixing assembly 1 further comprises a beam 20. The beam 20 is mounted above a reflector plate of the base station antenna and one or more transition block mounting units 10 are mounted on the beam 20, for example, in a rotationally snap-fit manner.

Figure 3A:
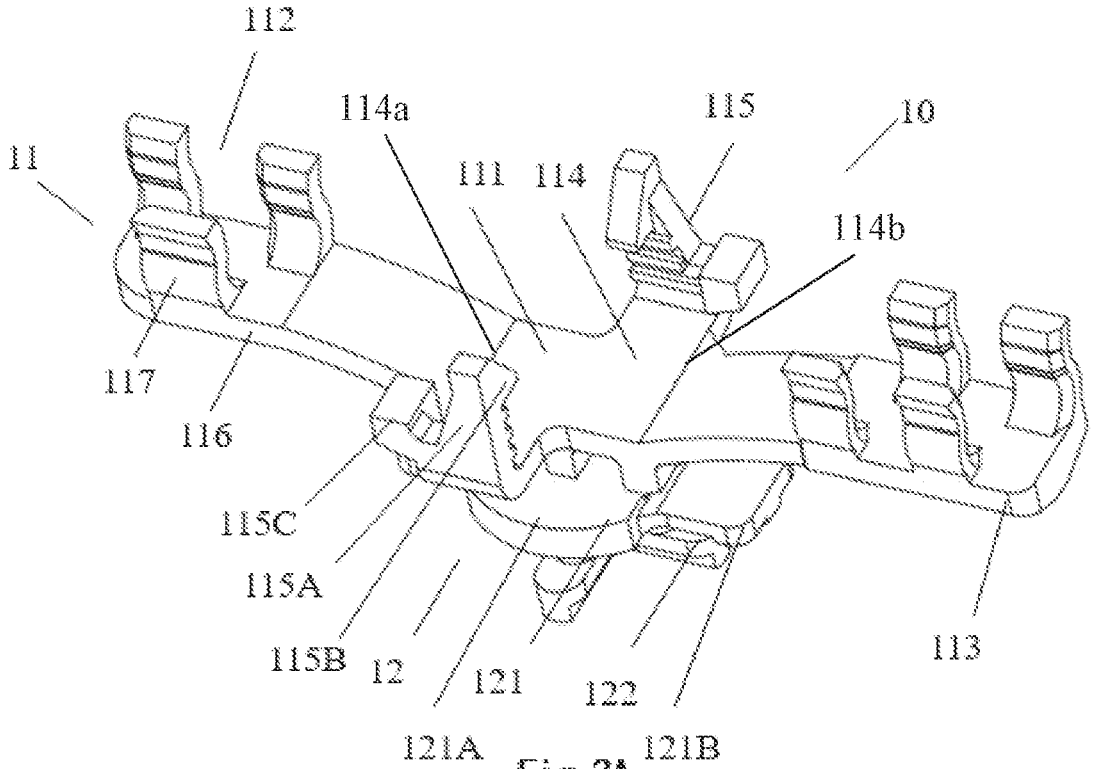
FIGS. 3A and 3B are perspective views of a transition block mounting unit according to an embodiment of the present invention.
Figure 3B:
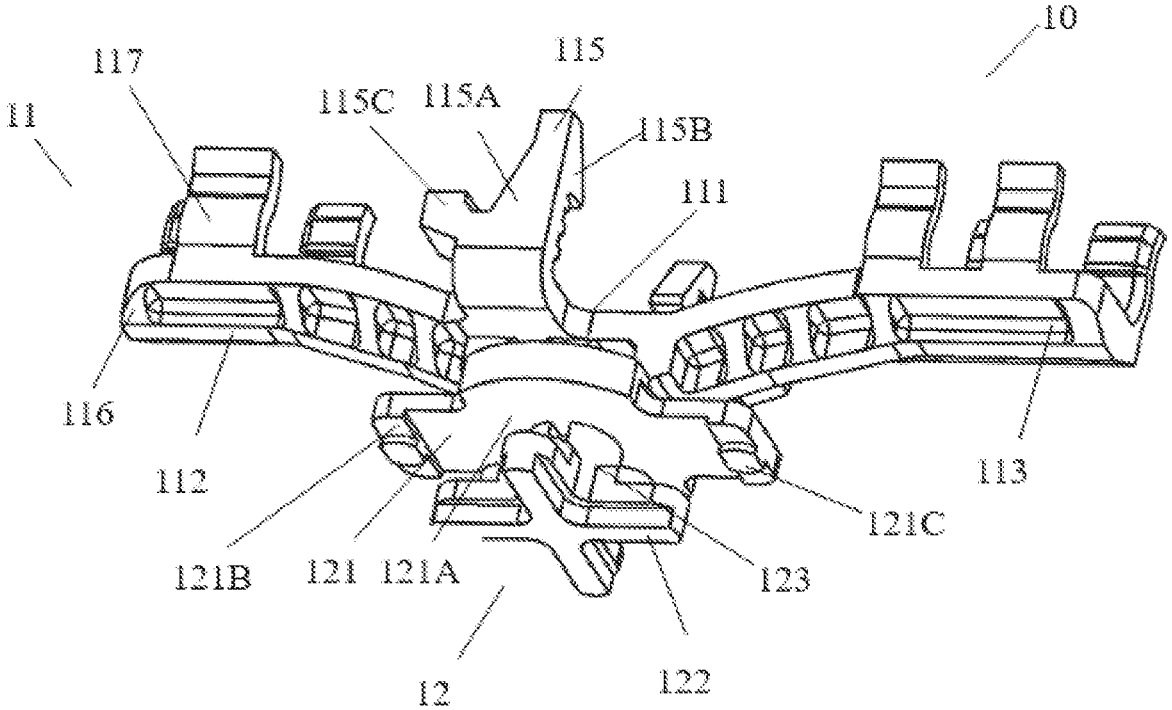

FIGS. 3A and 3B are perspective views of a transition block mounting unit 10 according to an embodiment of the present invention. As shown in the drawings, the transition block mounting unit 10 includes an upper support member 11 and a lower connecting member 12. The support member 11 is used for supporting the transition block 30 and the two cables 41 and 42 that are connected to the transition block 30, and the connecting member 12 is used to mount the transition block mounting unit 10 to an inner element (for example, a reflector plate) of the base station antenna, or to a beam 20, which in turn is fixed to the base station antenna.

The support member 11 includes a central transition block support portion 111 and cable support portions 112 and 113 located on longitudinal sides of the central transition block support portion 111. The transition block support portion 111 supports the transition block 30, and includes a bottom plate 114 and a plurality of claws 115 projecting vertically upward from opposed transverse sides of the bottom plate 114. The claws 115 fix the transition block 30 in place on the bottom plate 114. Each claw 115 includes a vertical stem 115A, and a hook 115B that projects from the top of the stem 115A toward the interior of the support member 11. The vertical stems 115A may each have a plate shape and may protrude upwardly from the bottom plate 114 in a cantilevered manner. The vertical stems 115A have a degree of elasticity. In the process of inserting the transition block 30 within the transition block support portion 111 from top to bottom, the side walls of the transition block 30 abut against the hooks 115B, thereby causing the vertical stems 115A to flex outwardly, and after the transition block 30 completely passes through the hooks 115B, the vertical stems 115A resume their original shape, and the hooks 115B fix the transition block 30 in place mounted on the bottom plate 114, preventing the transition block 30 from moving in the vertical direction. In some embodiments, the two claws 115 are offset from one another in the longitudinal direction. One or more of the claws 115 may also include a hook 115C that protrudes from the side of the stem 115A toward the inside of the support member 11. The hooks 115C may be used to fix the position of the transition block 30 in the longitudinal direction, preventing the transition block 30 from moving back and forth in the longitudinal direction.

The cable support portions 112 and 113 are disposed on the opposed longitudinal sides of the transition block support portion 111, and are used for supporting the two cables 41 and 42 that are interconnected within the transition block 30. The cable support portions 112 and 113 each include a bottom plate 116 and a plurality of claws 117 projecting vertically upward from opposed transverse sides of the respective bottom plates 116. Each bottom plate 116 is connected to a respective longitudinal side 114*a*, 114*b* of the bottom plate 114 of the transition block support portion 111. Each claw 117 may have an undulating profile along a vertical axis, which may help reduce or prevent back and forth movement of the cables 41 and 42 in the vertical direction.

In some embodiments, the cable support portions 112 and 113 have a different number of claws 117 so that an operator may easily distinguish between the cable support portion 112 and the cable support 113 for different cables. This arrangement may be advantageous, for example, when the cable support portions 112, 113 are designed to accommodate different sized cables.

Figure 4:
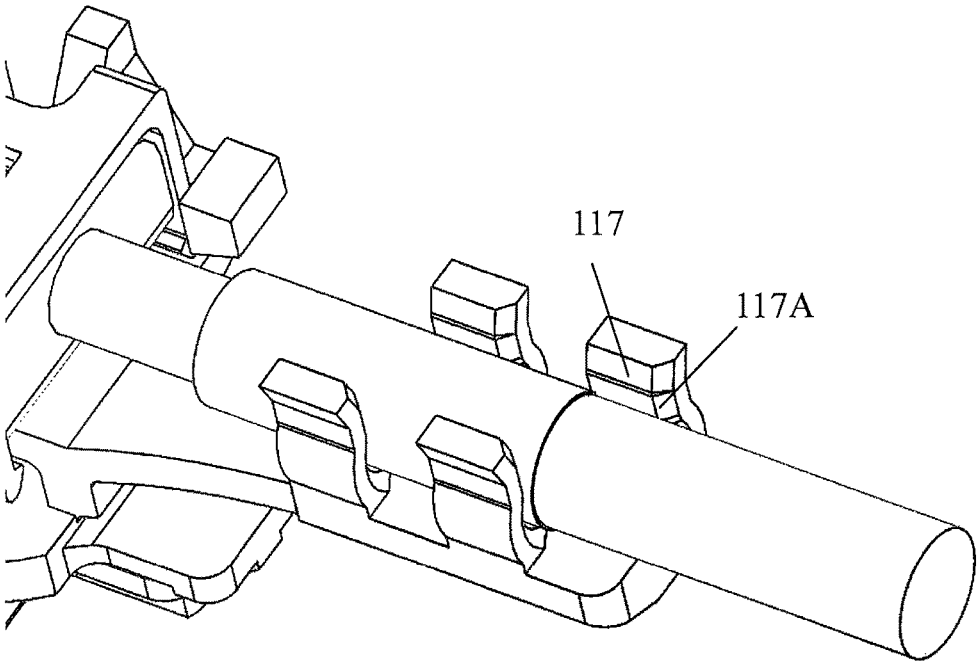
FIG. 4 is an enlarged partial view of the transition block mounting unit of FIGS. 3A-3B with a cable and a transition block mounted therein.

In some embodiments, as shown in FIG. 4, chamfers 117A are provided along the inner surfaces of the claws 117 to reduce the risk that sharp edges on the claws 117 cut or otherwise damage the cables 41, 42.

Figure 5:
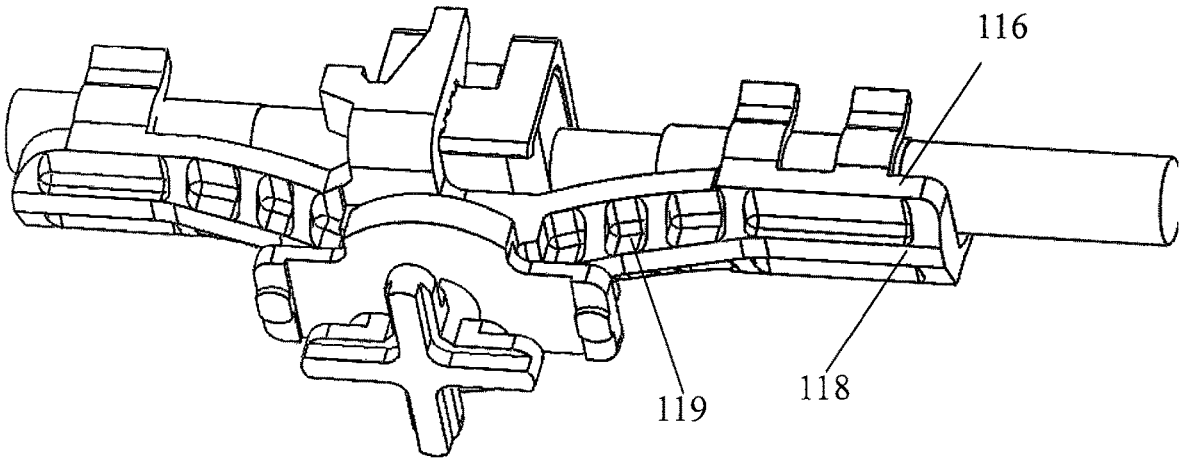
FIG. 5 is a perspective view of the transition block mounting unit of FIGS. 3A-3B with cables and a transition block mounted therein.

In some embodiments, as shown in FIG. 5, a longitudinal projection 118 may be provided below the bottom plate 116. The longitudinal projection 118 may be configured to be received within a cut-out 202A in the beam 20 after the transition block mounting unit 10 is mounted on the beam 20 (it will be elaborated in detail hereinafter) so as to resist rotation of the transition block mounting unit 10 relative to the beam 20.

In some embodiments, as shown in FIG. 5, transversely-extending ribs 119 may be provided below the bottom plate 116 to reinforce the bottom plate 116.

Returning to FIGS. 3A and 3B, the connecting member 12 is used for connecting the transition block mounting unit 10 to an inner element of the base station antenna or directly to a beam 20. The connecting member 12 is connected to (and typically integral with) the lower portion of the support member 11, and includes an upper connecting portion 121 and a lower connecting portion 122 that are connected by a cylindrical body 123. The connecting member 12 clamps to the upper and lower surfaces of the inner element of the base station antenna or the beam 20 by the upper connecting portion 121 and the lower connecting portion 122.

The upper connecting portion 121 has a substantially plate shape, and includes a body 121A and an elastic pressing portion 121B that projects outwardly and downwardly from opposed longitudinal sides of the body 121A in a cantilevered manner. The body 121A fixes the connecting member 12 to the bottom plate 114 of the transition block support portion 111 of the support member 11. The pressing portion 121B is used for pressing on the upper surface of the inner element of the base station antenna or the beam 20 when the connecting member 12 is connected to the inner element of the base station antenna or the beam 20, to adjust the gap between the upper and lower connecting portions 121 and 122 to prevent the connecting member 12 from moving back and forth in the vertical direction.

In some embodiments, the cantilevered end of the elastic pressing portion 121B is provided with a flange 121C that extends downwardly, for clamping into a hole 201B in the inner element of the base station antenna or the beam 20 (it will be elaborated in detail hereinafter), thereby preventing the connecting member 12 from rotating relative to the inner element of the base station antenna or the beam 20.

The lower connecting portion 122 may have a substantially cross shape in an example embodiment. The center of the cross may be connected to the body 121A of the upper connecting portion 121 by a cylindrical body 123. The lower connection portion 122 may pass through a corresponding cross-shaped hole 201A on the inner element of the base station antenna or the beam 20 (it will be elaborated in detail hereinafter), and may then be rotated so that the arms of the cross-shaped lower connecting portion abut against the lower surface of the inner element of the base station antenna or the beam 20. Moreover, the elastic pressing portion 121B of the upper connecting portion 121 abuts against the upper surface of the inner element of the base station antenna or the beam 20.

Figure 6A:
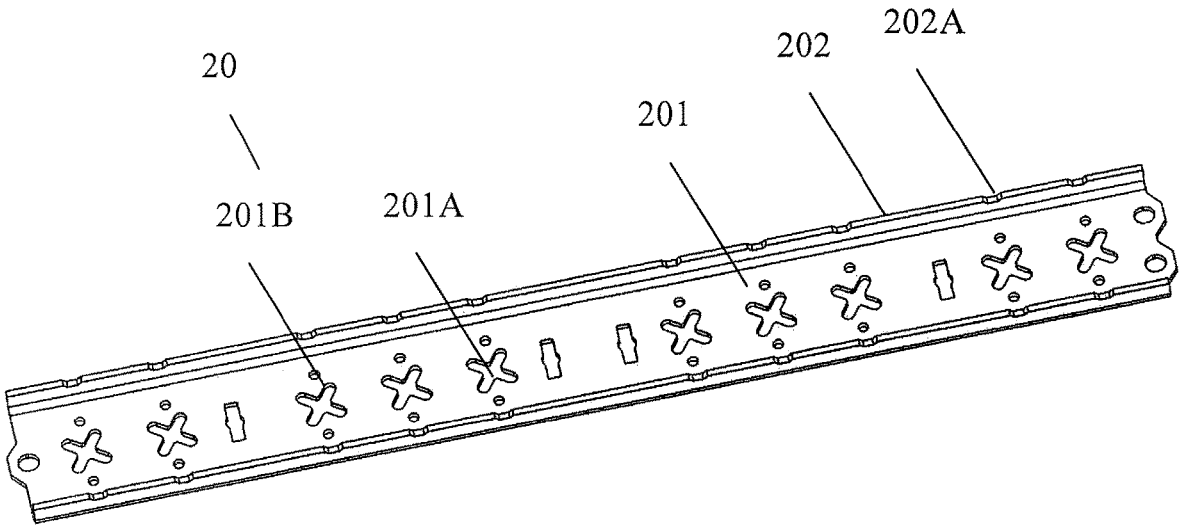
FIGS. 6A and 6B are perspective view and a cross-sectional view, respectively, of a beam according to an embodiment of the present invention.
Figure 6B:
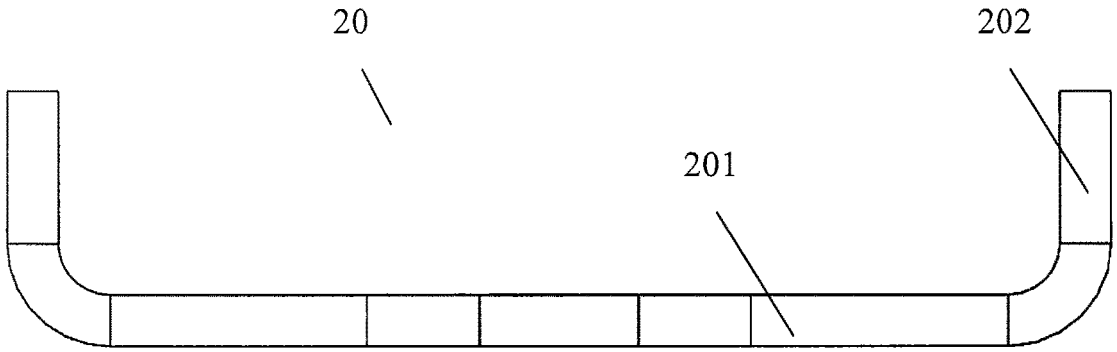

As described above with reference to FIG. 2, the transition block fixing assembly 1 may further comprise a beam 20. FIGS. 6A and 6B are perspective and cross-sectional views, respectively, of a beam 20 according to an embodiment of the present invention. The transition block mounting units 10 according to embodiments of the present invention may be mounted on the beam 20. As shown in the drawings, the beam 20 is substantially elongated and plate shaped, and further includes a pair of lips so that the beam 20 has a generally C-shaped cross section along its transverse direction. The beam 20 includes an elongated base plate 201, and a pair of lips in the form of support plates 202 that project vertically upward from both transverse sides of the base plate 201.

The base plate 201 includes a plurality of cross-shaped holes 201A in the longitudinal direction. The cross-shaped holes 201A may be sized to receive the lower connecting portion 122 of the connecting member 12 of a transition block mounting unit 10. As described above, a transition block mounting unit 10 may be mounted on the beam 20 by inserting the lower connecting portion thereof through one of the holes 201A and then rotating the transition block mounting unit 10. Two holes 201B that are spaced apart from the cross-shaped hole 201A are provided on opposed transverse sides of each cross-shaped holes 201A. The transition block mounting unit 10 may be rotated until the flanges 121C of the upper connecting portion 121 of the connecting member 12 are received within the respective holes 201B, thereby preventing the connecting member 12 from rotating further relative to the beam 20.

Figure 6C:
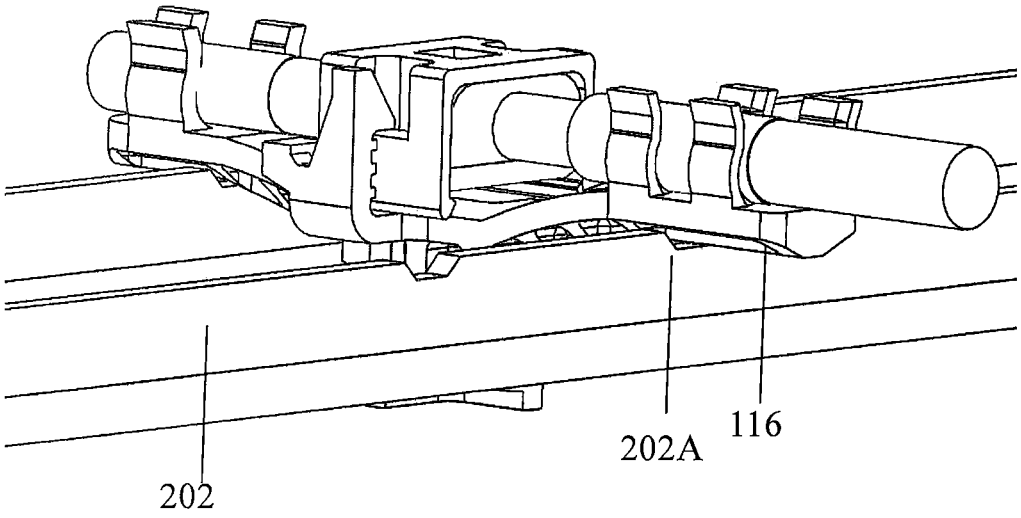
FIG. 6C is a perspective view of the beam of FIGS. 6A-6B with a transition block mounting unit according to an embodiment of the present invention installed therein.

The support plate 202 is disposed on both transverse sides of the base plate 201, and used for supporting the bottom plates 116 of the cable support portions 112 and 113 of the support member 11 of the transition block mounting unit 10, so as to reinforce the structure of the support member 11, as shown in FIG. 6C. Each support plate 202 may be provided with cut-outs 202A that receive the projections 118 of the cable support portions 112 and 113 of the support member 11 of the transition block mounting unit 10. These cut-outs 202A may help prevent the transition block mounting unit 10 from rotating relative to the beam 20.

Figure 6D:
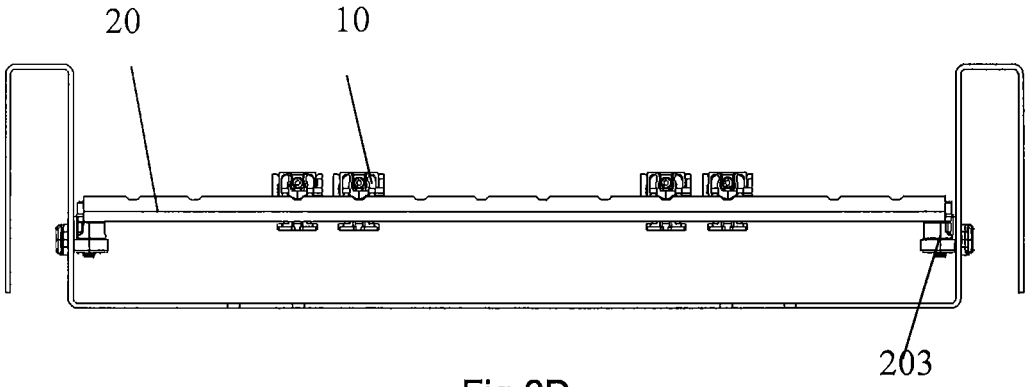
FIGS. 6D-6F are views of the beam of FIGS. 6A-6C mounted on the base station antenna.
Figure 6E:
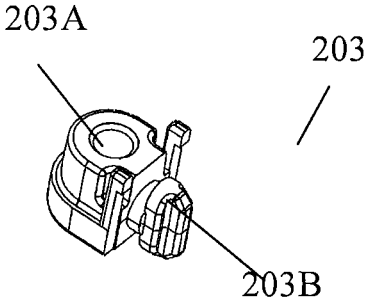
Figure 6F:
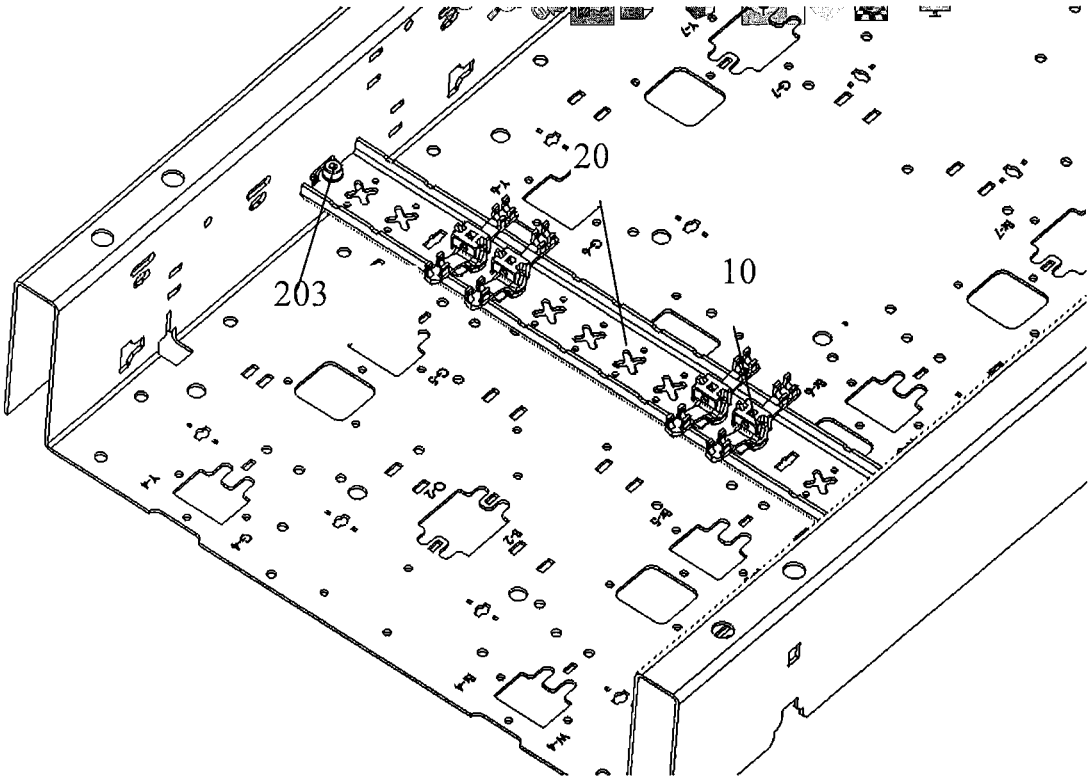

The beam 20 may be connected to the base station antenna in any mechanical manner such as welding, screws, clamping, and the like. In one embodiment, as shown in FIGS. 6D-6F, both ends of the base plate 201 are fixed to side walls of the base station antenna (e.g., side walls of the reflector plate) by adapters 203. The adapter 203 includes a base plate connecting portion 203A and a base station antenna connecting portion 203B that are connected to each other. The base plate connecting portion 203A is provided with a screw hole, for fixing to the base plate 201 by screws or other fasteners, and the base station antenna connecting portion 203B is provided with a projection, for clamping into a slot in the side wall of the base station antenna.

In the embodiment, the transition block mounting unit 10 is formed of a material such as nylon, and integrally formed by molding. The beam 20 may be formed of a material such as an aluminum alloy.

A method of using the transition block fixing assembly 1 according to an embodiment of the present invention will be described below with reference to FIGS. 7A-7C. First, the beam 20 is mounted to the interior of the base station antenna. This step may be omitted if the transition block mounting unit 10 is directly connected to an inner element of the base station antenna as opposed to the beam 20.

Figure 7A:
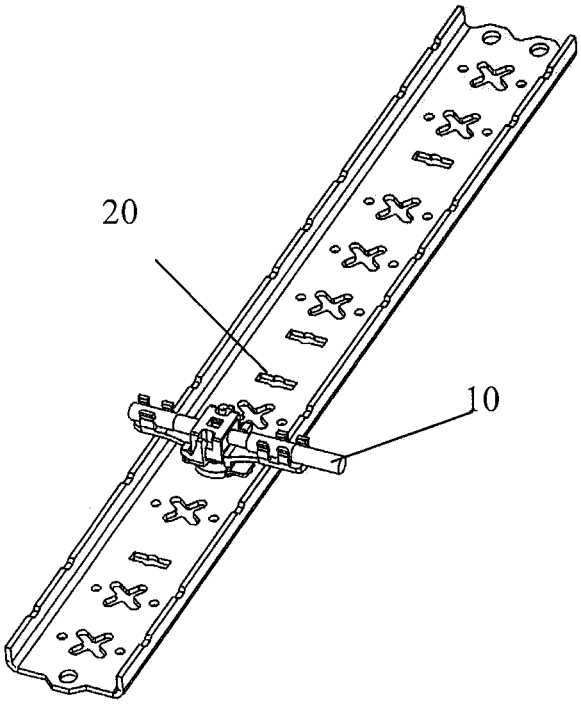
FIGS. 7A-7C are perspective views of a transition block fixing assembly according to an embodiment of the present invention that illustrate operational steps for mounting transition blocks using the assembly.

Then, as shown in FIG. 7A, a first transition block mounting unit 10 is connected to the inner element of the base station antenna or the beam 20. Specifically, the lower connecting portion 122 of the connecting member 12 of the transition block mounting unit 10 is passed through the cross-shaped hole 201A in the inner element of the base station antenna or the beam 20, and rotated by certain angle, so that the upper connecting portion 121 and the lower connecting portion 122 together clamp the upper and lower surfaces of the inner element of the base station antenna or the beam 20, and the elastic pressing portion 121B of the upper connecting portion 121 abuts against the upper surface of the inner element or the beam 20 by utilizing its elasticity, preventing the connecting member 12 from moving back and forth in the vertical direction.

The transition block mounting unit 10 continues to be rotated until the flanges 121C of the upper connecting portion 121 are clamped into the respective holes 201B of the inner element of the base station antenna or the beam 20, and the projections 118 of the support member 11 are clamped into the cut-outs 202A in the beam 20, thereby preventing the transition block mounting unit 10 from rotating relative to the inner element of the base station antenna or the beam 20.

Figure 7B:
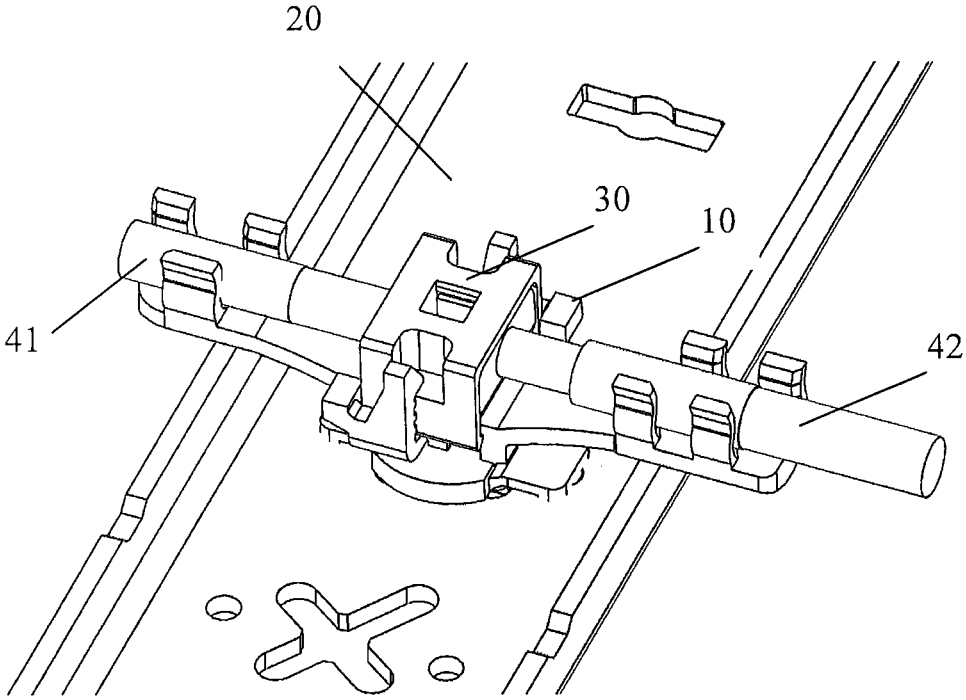
Figure 7C:
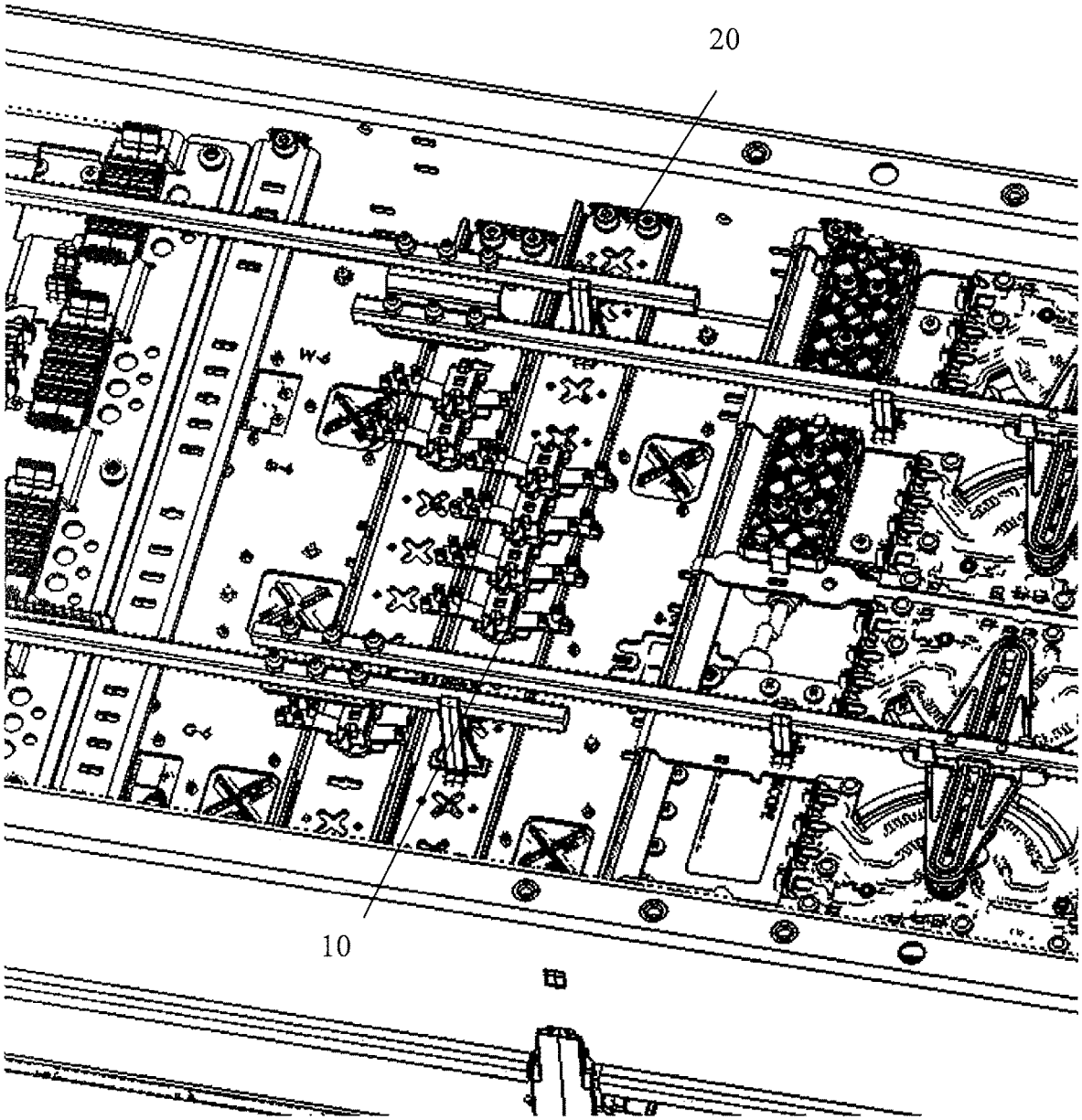

As shown in FIG. 7B, the transition block 30 is fitted from above into the transition block support portion 111 of the support member 11. The transition block 30 is placed on the bottom plate 114 of the transition block support portion 111, and the claws 115 fix the transition block 30 in place by the hooks 115B and 115C, preventing the transition block 30 from moving back and forth along the vertical or horizontal directions.

The jackets, the outer conductors and a portion of the dielectric spacer may be stripped off from one end of the cables 41 and 42 so as to expose the center conductors. The cables 41 and 42 are clamped within the claws 117 of the cable support portions 112 and 113 of the support member 11 of the transition block mounting unit 10, and the center conductors of the cables 41 and 42 are inserted into the through holes 31 of the transition block 30 from both longitudinal sides of the transition block 30 so that the ends of the center conductors of the cables 41, 42 are in contact with one another. Then, solder is supplied from the top hole 32 of the transition block 30, to weld the ends of the cables 41 and 42 together and fix the same to the transition block 30. Thus, the solder provides the mechanical and electrical connection between the cables 41 and 42. The outer conductors of the cables 41 and 42 may be electrically connected to each other in some other manner (i.e., by connecting each outer conductor to a ground reference such as the reflector plate). In an alternative embodiment, the center conductors of the cables 41 and 42 may also be first inserted into the transition block 30 and welded together, and then the transition block 30 is assembled together with the cables 41 and 42 onto the transition block support portion 111 and the cable support portions 112 and 113 of the support member 11 of the transition block mounting unit 10 respectively.

Thereby, the installation of the first transition block mounting unit 10 is completed. The above-described process may then be repeated to install the second to nth transition block mounting units 10 on the internal element of the base station antenna or the beam 20, as shown in FIG. 7C.

While the example embodiments of the invention described above focus on transition block fixing assemblies in which the transition block mounting unit is inserted within an opening and then rotated to fix the transition block mounting unit in place, it will be appreciated that the transition block fixing assemblies according to embodiments of the present invention are not limited thereto. For example, in other embodiments, the transition block mounting units may be inserted into an opening in a structural component of the base station antenna such as, for example, a beam or a reflector plate, and then slid horizontally (e.g., in the longitudinal or transverse projections) within a channel extending from the opening in order to mount the transition block mounting unit on the structural component. The connecting portion of the transition block mounting unit may again include an elastic pressing portion that engages the structural component to hold the transition block mounting unit in place, and may also include flanges and/or projections that mate with holes and/or cut-outs in the structural component to further assist in holding the transition block mounting unit in place after it has been inserted into the opening and slid into place.

In the transition block fixing assembly 1, the transition block mounting unit 10 can be mounted on the beam by a simple rotational movement, and the installation process is very simple. The transition block mounting units 10 are mounted to beam 20 at fixed positions, facilitating installation using a machine. In the transition block fixing assembly 1, the welded portion in the transition block 30 is readily accessible from the back of the base station antenna, and thus may be easily reworked if a problem with the solder joint is identified. In addition, the entire transition block fixing assembly 1 has a small thickness (about 19 mm), and as many as twelve transition blocks can be mounted side by side on the beam 20, which greatly saves the space within the base station antenna.

A person skilled in the art should understand that many changes and/or modifications may be made to the exemplary embodiments described above without departing from the spirit and scope of the present invention. Accordingly, all the changes and modifications are encompassed within the protection scope of the present disclosure as defined by the claims. The present invention is defined by the appended claims, and the equivalents of these claims are also contained therein.

That which is claimed is:

1. A transition block fixing assembly comprising:

a transition block mounting unit, the transition block mounting unit including an upper support member and a lower connecting member, wherein the upper support member is configured to support a transition block and a pair of cables that are received within the transition block, and the lower connecting member is configured to mount the transition block mounting unit within a base station antenna, wherein the upper support member includes a transition block support portion, and cable support portions located on opposed longitudinal sides of the transition block support portion, and wherein the transition block support portion includes a transition block bottom plate, and a plurality of transition block claws projecting upwardly from opposed transverse sides of the transition block bottom plate.

2. The transition block fixing assembly according to claim 1, wherein each of the transition block claws includes a stem, and a hook projecting from a top of the stem toward the interior of the upper support member.

3. The transition block fixing assembly according to claim 1, wherein each cable support portion includes a cable bottom plate, and a plurality of cable claws projecting upwardly from opposed transverse sides of the cable bottom plate.

4. The transition block fixing assembly according to claim 3, wherein each cable bottom plate is connected to a respective longitudinal side of the transition block bottom plate.

5. The transition block fixing assembly according to claim 3, wherein the cable support portions have different numbers of cable claws.

6. The transition block fixing assembly according to claim 1, wherein the lower connecting member is fixed below the upper support member, and includes an upper connecting portion and a lower connecting portion that are connected to each other.

7. The transition block fixing assembly according to claim 6, wherein the upper connecting portion is plate-shaped, and includes a body and an elastic pressing portion projecting from both longitudinal sides of the body.

8. The transition block fixing assembly according to claim 6, wherein the lower connecting portion has a cross shape, which has a center connected to the upper connecting portion by a cylindrical body.

9. The transition block fixing assembly according to claim 6, wherein the transition block mounting unit is integrally molded.

10. The transition block fixing assembly according to claim 1, further comprising a beam on which the transition block mounting unit is mounted.

11. The transition block fixing assembly according to claim 10, wherein the beam includes an elongated base plate, and support plates projecting vertically upward from transverse sides of the base plate.

12. The transition block fixing assembly according to claim 11, wherein the base plate is provided with a cross-shaped hole, and a lower connecting portion of the lower connecting member including an upper connecting portion and the lower connecting portion is correspondingly cross-shaped.

13. The transition block fixing assembly according to claim 11, wherein the base plate is provided with holes, and an upper connecting portion of the lower connecting member including the upper connecting portion and a lower connecting portion are provided with flanges so that rotation of the lower connecting member through a predetermined angle allows the flanges to clamp into respective holes in the base plate.

14. The transition block fixing assembly according to claim 13, wherein the support plate is provided with cut-outs so projections of the lower surface of the cable support portion are received in the cut-outs when the lower connecting member is rotated through the predetermined angle.

15. The transition block fixing assembly according to claim 10, wherein the beam is fixed to the base station antenna by an adapter which includes a base plate connecting portion and a base station antenna connecting portion that are connected to each other.

16. A transition block fixing assembly comprising:

a transition block mounting unit, the transition block mounting unit including an upper support member and a lower connecting member, wherein the upper support member is configured to support a transition block and a pair of cables that are received within the transition block, and the lower connecting member is configured to mount the transition block mounting unit within a base station antenna, wherein the upper support member includes a transition block support portion, and cable support portions located on opposed longitudinal sides of the transition block support portion, and wherein each cable support portion includes a cable bottom plate, and a plurality of cable claws projecting upwardly from opposed transverse sides of the cable bottom plate.

17. A transition block fixing assembly comprising:

a transition block mounting unit, the transition block mounting unit including an upper support member and a lower connecting member, wherein the upper support member is configured to support a transition block and a pair of cables that are received within the transition block, and the lower connecting member is configured to mount the transition block mounting unit within a base station antenna; and a beam on which the transition block mounting unit is mounted, wherein the beam is fixed to the base station antenna by an adapter which includes a base plate connecting portion and a base station antenna connecting portion that are connected to each other.

* * * * *